US010672264B2

(12) United States Patent
Downs et al.

(10) Patent No.: US 10,672,264 B2
(45) Date of Patent: Jun. 2, 2020

(54) PREDICTIVE INCIDENT AGGREGATION

(71) Applicant: HERE Global B.V., Eindhoven (NL)

(72) Inventors: Oliver Downs, Redmond, WA (US); Toby Tennent, Chicago, IL (US); Praveen Arcot, Naperville, IL (US)

(73) Assignee: HERE Global B.V., Eindhoven (NL)

( * ) Notice: Subject to any disclaimer, the term of this patent is extended or adjusted under 35 U.S.C. 154(b) by 266 days.

(21) Appl. No.: 15/437,113

(22) Filed: Feb. 20, 2017

(65) Prior Publication Data

US 2017/0162041 A1 Jun. 8, 2017

Related U.S. Application Data

(63) Continuation of application No. 14/171,049, filed on Feb. 3, 2014, now Pat. No. 9,613,529.

(51) Int. Cl.
*G08G 1/01* (2006.01)

(52) U.S. Cl.
CPC ..... *G08G 1/0129* (2013.01); *G08G 1/0112* (2013.01); *G08G 1/0141* (2013.01)

(58) Field of Classification Search
CPC .. G08G 1/0141; G08G 1/0104; G08G 1/0129; G08G 1/0133; G01C 21/3492
See application file for complete search history.

(56) References Cited

U.S. PATENT DOCUMENTS 7,176,813 B2 * 2/2007 Kawamata ..... B60R 11/04 340/905
8,064,925 B1 * 11/2011 Sun ..... G08G 1/012 455/456.1
8,103,435 B2 * 1/2012 Yang ..... G01C 21/3492 701/117
8,532,920 B2 * 9/2013 Coleman ..... G01C 21/3492 701/410
8,793,063 B2 * 7/2014 Horvitz ..... G01C 21/3461 701/119

(Continued)

FOREIGN PATENT DOCUMENTS

CN 202075862 U 12/2011
JP H09297898 A 11/1997
JP 2007179348 A 7/2007

OTHER PUBLICATIONS

Horvitz E., J. Apacible, R. Sarin, and L. Liao (2005). Prediction, Expectation, and Surprise: Methods, Designs, and Study of a Deployed Traffic Forecasting Service, Twenty-First Conference on Uncertainty in Artificial Intelligence, UAI-2005, Edinburgh, Scotland, Jul. 2005, 11 pages.

(Continued)

*Primary Examiner* — Ryan Rink
(74) *Attorney, Agent, or Firm* — Alston & Bird LLP

(57) ABSTRACT

In one embodiment, an incident report including a path segment identifier and an incident identifier is received at a computing device. The incident identifier is sent to a traffic prediction model. The traffic prediction model returns a traffic distribution value. The traffic distribution value identifies a portion of a traffic prediction distribution derived from historical data. The computing device accesses a lookup table according to traffic distribution value and the path segment identifier to receive a speed prediction.

19 Claims, 12 Drawing Sheets

(56) References Cited

U.S. PATENT DOCUMENTS 8,892,345 B2 * 11/2014 Arcot ..... G08G 1/0129 429/143
8,909,463 B2 * 12/2014 Chapman ..... G01C 21/3691 701/118
8,947,263 B2 * 2/2015 Garay ..... G08G 1/0116 340/934
8,954,278 B2 * 2/2015 Tennent ..... G01C 21/32 701/532
9,008,954 B2 * 4/2015 Miller ..... G08G 1/0104 701/117
9,014,632 B2 * 4/2015 Peterson ..... G01S 5/0027 455/41.2
2006/0055565 A1 3/2006 Kawamata et al.
2006/0082472 A1 * 4/2006 Adachi ..... G08G 1/096716 340/995.13
2007/0208498 A1 * 9/2007 Barker ..... G08G 1/0104 701/117
2008/0140303 A1 * 6/2008 Hiruta ..... G08G 1/0104 701/116
2008/0162027 A1 * 7/2008 Murphy ..... B60W 50/14 701/117
2008/0319639 A1 12/2008 Yamane
2009/0105949 A1 4/2009 Bitan
2011/0112747 A1 * 5/2011 Downs ..... G08G 1/0104 701/118
2012/0276847 A1 11/2012 Peterson
2013/0151152 A1 6/2013 Tennent et al.
2013/0211706 A1 * 8/2013 MacNaughtan ..... G08G 1/0112 701/410
2013/0253808 A1 * 9/2013 He ..... G06Q 10/00 701/117
2013/0289864 A1 * 10/2013 Miller ..... G08G 1/0116 701/119
2013/0289865 A1 10/2013 Miller et al.
2013/0311076 A1 * 11/2013 Mieth ..... G01C 21/32 701/119
2014/0032091 A1 1/2014 Arcot et al.
2014/0114556 A1 * 4/2014 Pan ..... G08G 1/00 701/119
2014/0244148 A1 * 8/2014 Horvitz ..... G01C 21/3461 701/118
2014/0278032 A1 * 9/2014 Scofield ..... G01C 21/3492 701/118
2015/0206427 A1 * 7/2015 Blandin ..... G08G 1/0129 701/117
2016/0025510 A1 * 1/2016 Belzner ..... G08G 1/0112 701/533

OTHER PUBLICATIONS

Office Action from U.S. Appl. No. 14/171,049, dated Feb. 10, 2016, 14 pages.
Office Action from U.S. Appl. No. 14/171,049, dated Jun. 28, 2016, 16 pages.
Office Action from U.S. Appl. No. 14/171,049, dated May 29, 2015, 12 pages.
Office Action from U.S. Appl. No. 14/171,049, dated Oct. 9, 2015, 12 pages.
He et al., Incident Duration Prediction with Hybrid Tree-based Quantile Regression, Jun. 21, 2011, IBM Research Report.
Guan, L. et al., *Traffic Incident Duration Prediction Based on Artificial Neural Network*, 2010 International Conference on intelligent Computation Technology and Automation, IEEE Computer Society (May 2010) 1076-1079.

* cited by examiner

141

| Path | Segment | TD VALUE | Minimum | Maximum | Average |
|---|---|---|---|---|---|
| A | A1 | 4 | 2 | 5 | 4 |
| A | A1 | 3 | 6 | 15 | 12 |
| A | A1 | 2 | 15 | 45 | 30 |
| A | A1 | 1 | 46 | 50 | 49 |
| A | A1 | 0 | 51 | 60 | 58 |
| C | C1 | 4 | 0 | 3 | 3 |
| C | C1 | 3 | 4 | 20 | 15 |
| C | C1 | 2 | 21 | 50 | 47 |
| C | C1 | 1 | 51 | 70 | 65 |
| C | C1 | 0 | 71 | 80 | 73 |

FIG. 5

PREDICTIVE INCIDENT AGGREGATION

This application is a continuation under 37 C.F.R. § 1.53(b) and 35 U.S.C. § 120 of U.S. patent application Ser. No. 14/171,049 filed Feb. 3, 2014 which is incorporated by reference in its entirety.

FIELD

The following disclosure relates to traffic speed predictions, or more particularly, a traffic speed predictions in response to an incident.

BACKGROUND

Traffic Message Channel (TMC) and other traffic services deliver traffic information to customers. Traffic incidents and traffic flow are reported through broadcasts. Traffic delays may be caused by one or more of congestion, construction, accidents, special events (e.g., concerts, sporting events, festivals), weather conditions (e.g., rain, snow, tornado), and so on.

In some areas, broadcast messages contain up-to-the-minute reports of traffic and road condition information. These systems broadcast the traffic data over traffic message channels on a continuous, periodic, or frequently occurring basis. Traffic message receivers decode the data and provide up-to-the-minute reports of traffic and road conditions.

While near real time reports of traffic are useful, challenges remain in the development of reliable and efficient predictive models for future traffic conditions.

SUMMARY

In one embodiment, an incident report including a path segment identifier and an incident identifier is received at a computing device. The incident identifier is sent to a traffic prediction model. The traffic prediction model returns a traffic distribution value. The traffic distribution value identifies a portion of a traffic prediction distribution derived from historical data. The computing device accesses a lookup table according to traffic distribution value and the path segment identifier to receive a speed prediction.

BRIEF DESCRIPTION OF THE DRAWINGS

Exemplary embodiments of the present invention are described herein with reference to the following drawings.

FIG. 5 illustrates an example chart of traffic predictions for the traffic distribution values.

DETAILED DESCRIPTION

A relationship exists between traffic incidents and traffic speed. An accident on a roadway results in slower traffic speeds for a period of time along the roadway. In some circumstances, the accident could result in delays on arteries leading to and even away from the roadway. Modeling this relationship has not been possible from data feeds due to the low quality of available traffic incident data and the lack of reliable prediction models.

If an accident occurs, depending on the context of the incident and its severity, there will be both an immediate and subsequent impact on traffic flow in the area of the incident and nearby connected roads. Even with high quality traffic incident data, the breadth and sparseness in terms of descriptive detail (how frequently any particular incident type occurs) and in terms of frequency of events at a given location, result in incident attributes that add noise to a predictive model of traffic flow conditions in the presence of an incident, despite the colloquial expectation one might have to the contrary.

The following examples include traffic incident data of a higher quality and traffic speed modeling techniques tailored to the available traffic incident data. The traffic incident data may be divided into the type of incident. Example types of incident include road hazards, vehicle accidents, weather, and other incidents. The type of incident may be further divided according to the location of the incident with respect to the roadway. Example locations include in a lane, on the shoulder, in a median, and other locations. The data may also be divided as a function of distance from the incident or time since the incident. This multi-layered approach to the incident data provides the requisite level of specificity to derive a predictive model for future traffic speed.

Figure 1:
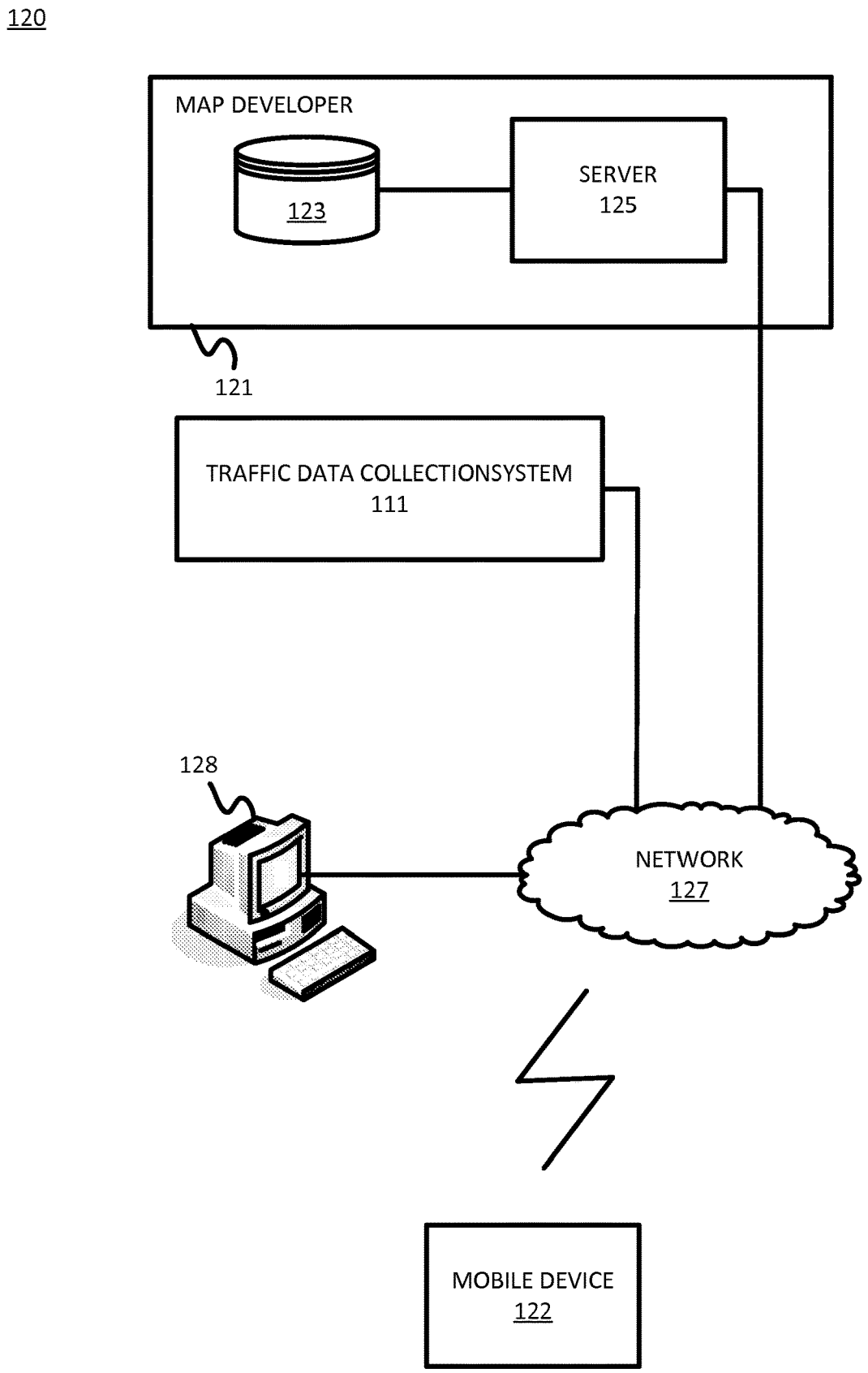
FIG. 1 illustrates an example system for a predictive traffic model.

FIG. 1 illustrates an example system 120 for a predictive traffic model. The system 120 includes a developer system 121, a mobile device 122, a workstation 128, a traffic data collection system 111 and a network 127. Additional, different, or fewer components may be provided. For example, many mobile devices 122 and/or workstations 128 connect with the network 127. The developer system 121 includes a server 125 and a database 123. The developer system 121 may include computer systems and networks of a system operator.

Traffic data collection system 111 may include or receive data from an incident reporting device and/or a speed data collection device. The incident reporting device may include a police scanner, camera, telephone, text message, a social networking service, a mobile application, or another incident reporting device for receiving incident data regarding incidents. The incidents may be reported by time and location. The speed data collection device may include a camera, traffic sensors, mobile probes (e.g., executed by smartphones), or another traffic collection device. Traffic data collection system 111 collects the incident data and speed data and sends the data to the developer system 121 directly or through network 127. The incident data and speed data may be compiled by the traffic data collection system 111 or by the developer system 121 as historical speed data and historical incident data.

The database 123 stores the historical speed data and historical incident data. The server 125 or another device at the developer system 121 may develop a traffic prediction model based on the historical speed data and historical incident data. The historical incident data may be classified by type of incident, location of the incident with respect to the center line of the path, and/or another factor. The historic incident data may include timestamps and/or location stamps.

Later in time (e.g., at any time after the traffic prediction model has been created), the server 125 receives an incident report including a path segment identifier and an incident identifier. The incident report may be generated by the traffic data collection system 111. The incident identifier includes an alphanumeric code that represents the type or category of incident. The alphanumeric code, or another code, may also describe a sub-type or sub-category. The path segment identifier describes the road and/or portion of the road where the incident occurred or is occurring. The term path and path segments may include various types of pathways (e.g., a highway, city street, bus route, train route, walking/biking pathway, or waterway). The term road and road segments may include paths for motor vehicles (e.g., a highway, a city street, or a road).

The path segment identifier may include a road classification value. The road classification value may be a rank of a road segment that may correspond to its functional class. Example functional classes include arterial roads, collector roads, and local roads. The prerecorded path may include roads outside of the functional classification system. Alternatively, an additional functional classification (e.g., private roads, temporary roads, or personalized roads) may be added to the geographic database to distinguish the prerecorded paths from other segments. Incident rates may be assigned to road segments based on functional classification.

The path segment identifier, the incident identifier, or both are sent to a traffic prediction model. The traffic prediction model may be executed on the server 125 or an external device. The traffic prediction model may be a decision tree, a neural network, a fuzzy network, or another type of machine learning algorithm. The path segment identifier, the incident identifier, or both are supplied to the traffic prediction model as inputs, and a traffic distribution value is returned from the traffic prediction model. The traffic distribution value is a numerical representation (e.g., single digit or decimal value) of a traffic prediction based on the incident identifier. The traffic distribution value may be representative of the path described by the path segment identifier. Alternatively, the traffic distribution value may be applicable to all path segments.

The traffic distribution value is a statistical place holder that represents the predicted traffic. For example, a traffic distribution value of 1 may correspond to a predicted speed range of 30-40 miles per hour and a traffic distribution value of 2 may correspond to a predicted speed range of 17-29 miles per hour. Upon receipt of the traffic distribution value, the server 125 may access a lookup table that associates traffic distribution values with corresponding predicted speed ranges or ranges of percentage or fractional impact on speed or travel time. The lookup table may be selected or internally organized according to the path segment identifier.

The server 125 may generate a message including data indicative of the predicted speed range and send the message to the mobile device 122. The mobile device 122 may represent the speed range on a map including the path from the path segment identifier encoded with a graphical indicator. The graphical indicator may be one color (e.g., green) for high speeds, a second color (e.g., yellow) for medium speeds, and a third color (e.g., red) for low speeds. The graphical indicator may be directly tied to the traffic distribution value (e.g., 0=green, 1=yellow, 2=red). As an alternative to color, the graphical indicator may be a size of the path (e.g., high traffic areas are shown constricted on the map), the graphical indicator may be a vehicle animation (e.g., vehicles are shown in animation at a speed proportional to the predicted speed), the graphical indicator may be a speed value shown on the map with text, or the graphical indicator may be shown in another fashion. Other application at the mobile device 122 may utilize the predicted speed range. The mobile device 122 may alter a route based on the predicted speed range. The mobile device 122 may present a traffic warning the user. The predicted speed range may be set to decay over time according to the type of incident. The incident types may be assigned decay time periods from a few minutes to a few hours.

In another example, the server 125 may send the message including the predicted speed range to another device. One example application includes guidance for emergency vehicles, delivery vehicles, or another centrally controlled fleet of vehicles. In another example, the server 125 sends traffic reports including the predicted speed range to a television station, a computer, or a mobile device. The server 125 may provide the predicted speed ranges to a traffic data application programming interface for various types of mobile applications executable by the mobile device 122.

The mobile device 122 is a smart phone, a mobile phone, a personal digital assistant ("PDA"), a tablet computer, a notebook computer, a personal navigation device ("PND"), a portable navigation device, and/or any other known or later developed portable or mobile computing device. The mobile device 122 includes one or more detectors or sensors as a positioning system built or embedded into or within the interior of the mobile device 122. The mobile device 122 receives location data from the positioning system.

The optional workstation 128 is a general purpose computer including programming specialized for the following embodiments. For example, the workstation 128 may receive user inputs for defining the number of traffic distribution value divisions or the statistical type of traffic distribution values. The workstation 128 may receive user inputs for manually defining the speed ranges for the traffic distribution values. The workstation 128 includes at least a memory, a processor, and a communication interface.

The developer system 121, the workstation 128, and the mobile device 122 are coupled with the network 127. The phrase "coupled with" is defined to mean directly connected to or indirectly connected through one or more intermediate components. Such intermediate components may include hardware and/or software-based components. The computing resources may be divided between the server 125 and the mobile device 122. In some embodiments, the server 125 performs a majority of the processing. In other embodiments, the mobile device 122 or the workstation 128 performs a majority of the processing. In addition, the processing is divided substantially evenly between the server 125 and the mobile device 122 or workstation 128.

Figure 2:
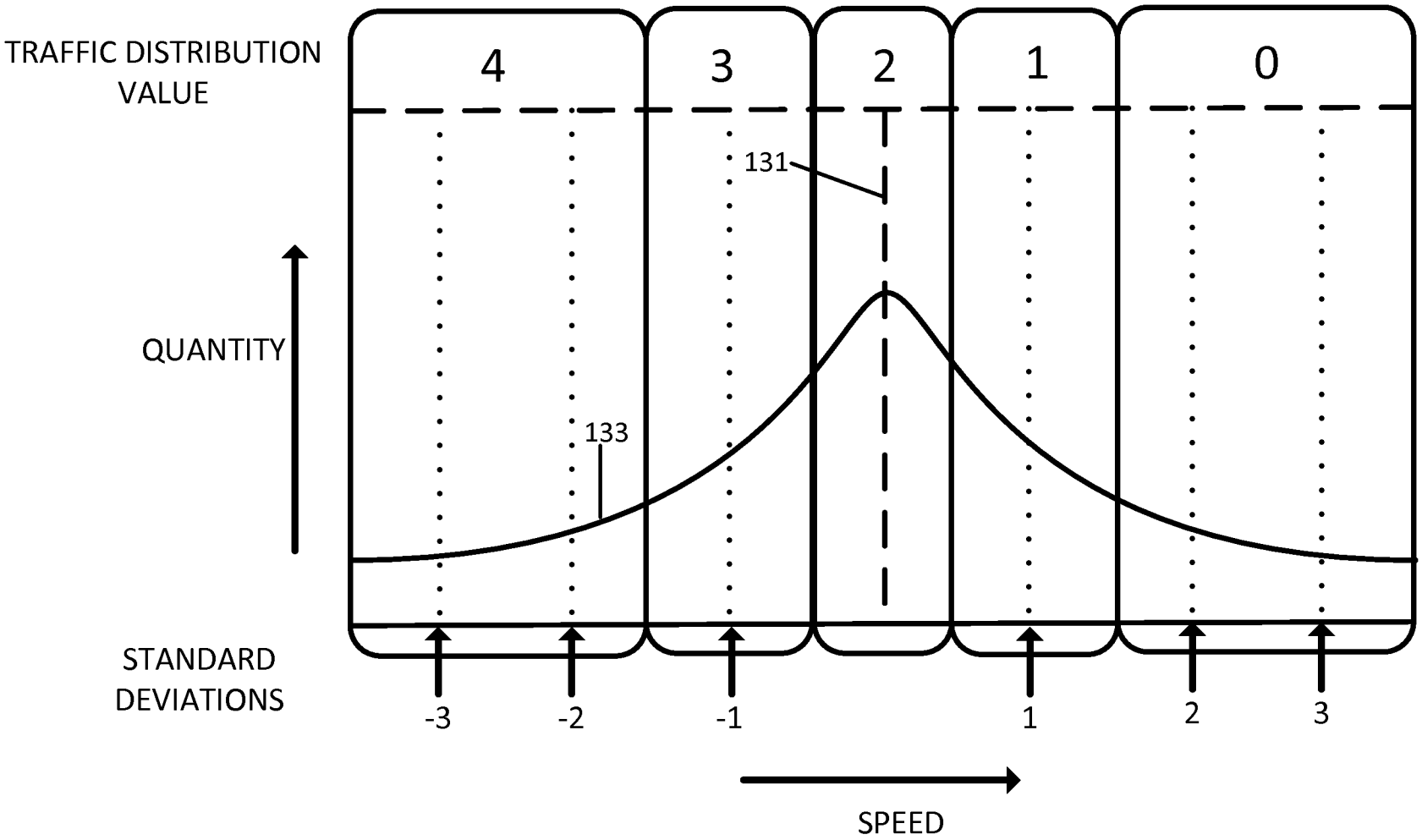
FIG. 2 illustrates an example set of traffic distribution values.

FIG. 2 illustrates an example set of traffic distribution values. The server 125 or the mobile device 122 may include an index, a lookup table, or another arrangement that associates an input traffic distribution value with a corresponding speed range. The set of traffic distribution values may be historical traffic data collected by any of the sources described above. The traffic distribution values may be associated with a specific path, a specific path segment, or a functional classification of paths. The traffic distribution values may be associated with a time epoch. Example sizes for the time epoch include 15 minutes, 30 minutes, 1 hour, or another value. In another example, the traffic distributions are associated with a peak time designation or an off-peak time designation.

Various types of distributions are possible for the historical traffic data. A normal distribution 133 having a mean 131 is shown in FIG. 2. The historical traffic data is divided by population into statistical groupings. For example, FIG. 2 illustrates five quintiles, labeled 0 through 4. The quintile 0 corresponds to the fastest 20% of the speed data, quintile corresponds to the next 20% of the speed data, and so on, until the quintile 4 corresponds to the slowest 20% of the speed data. Other arrangements such as tertiles, quartiles, deciles, centiles, or any division of the data may be used.

In another example, the limits of the divisions may be bound by standard deviations, as shown in the alternative by the dotted lines in FIG. 2. Thus, the divisions of data may not be evenly distributed by population. For example, each of the regions between the mean to the first standard deviation may include 34% of the historical traffic data, each of the regions between the standard deviation to the second deviation may include 13.5% of the historical traffic data, and each of the region between the second deviation and the third deviation may include 2.5% of the data.

Figure 3:
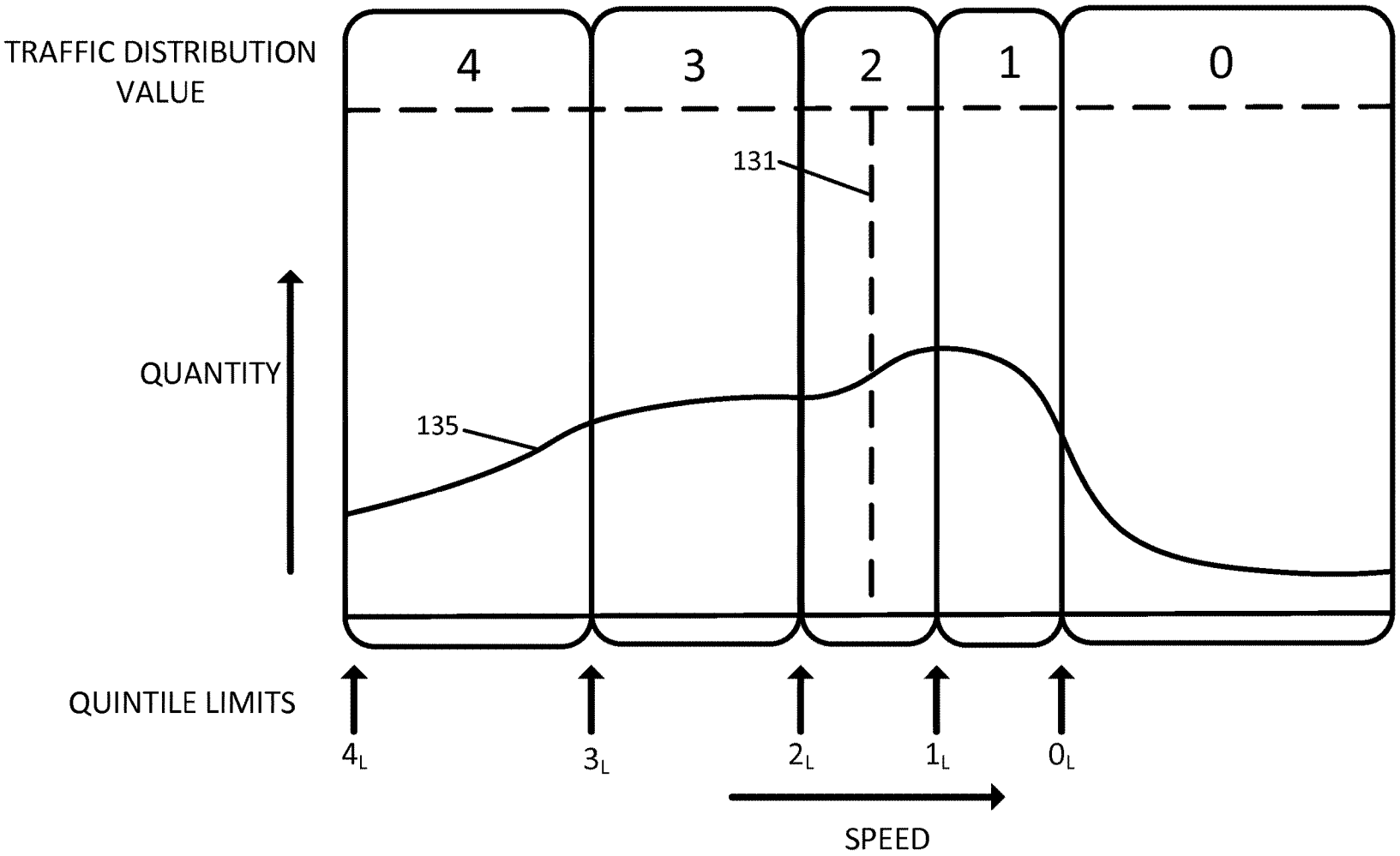
FIG. 3 illustrates another example set of traffic distribution values.
Figure 4:
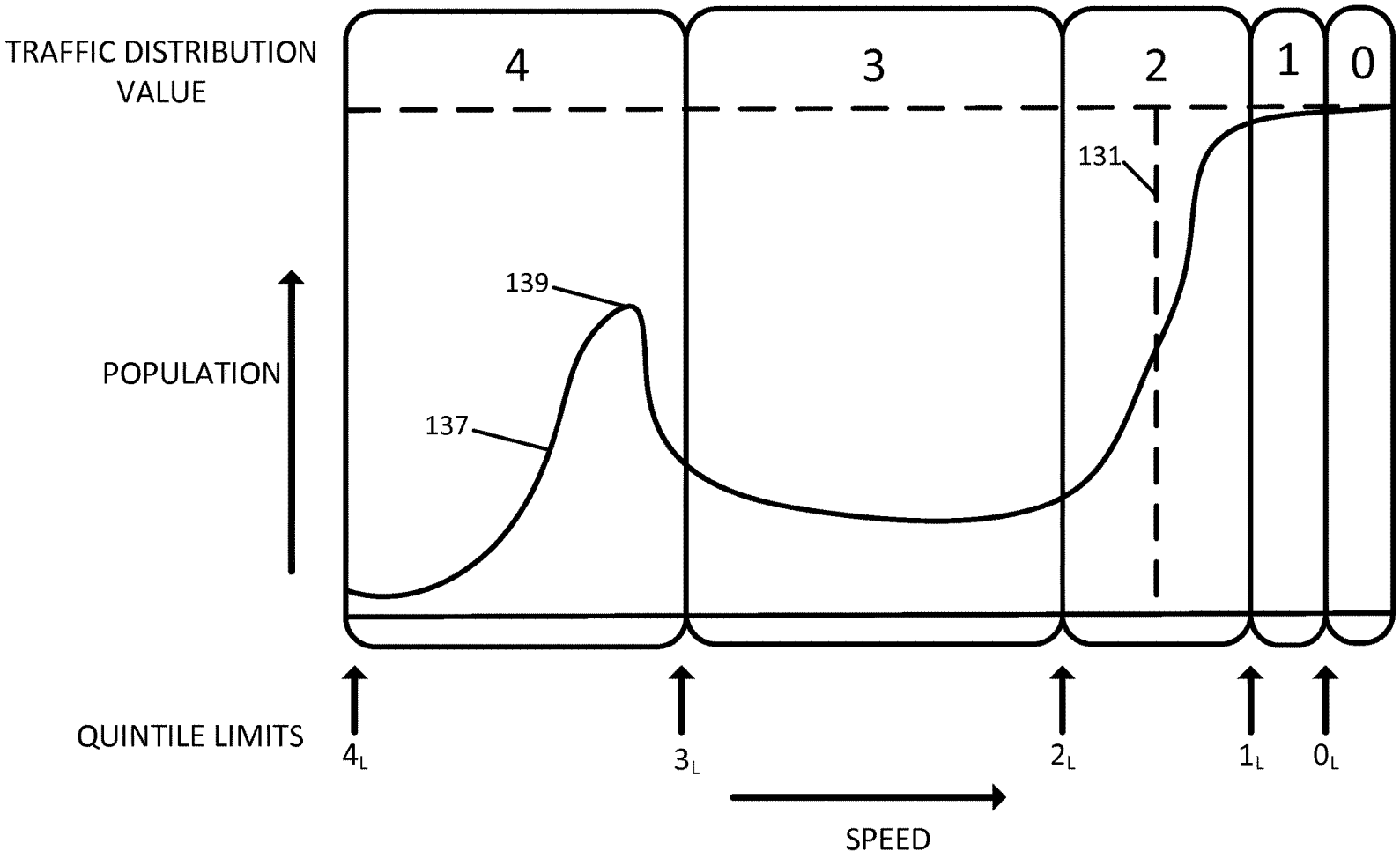
FIG. 4 illustrates another example set of traffic distribution values.

Other distributions are possible for the historical traffic besides a normal distribution. For example, FIGS. 3 and 4 illustrate non-gaussian examples. FIG. 3 illustrates example set of traffic distribution values having a high traffic distribution 135. The high traffic distribution 135 may include a quintile 0 that is wide because proportionally less data is included at high speeds. The mean 131 may be significantly lower than the speed limit of the path. The quintiles may be defined according to lower limits for the speed range (e.g., $4_L$, $3_L$, $2_L$, $1_L$, and $0_L$). FIG. 4 illustrates another example set of traffic distribution values having a distribution 137. The distribution 137 includes a majority of the speed data at or near the speed limit, which creates narrow quintiles 0 and 1. The distribution 137 also includes a local peak 139. The local peak 139 may correspond to the typical slow speed of a congested path. The local peak 139 illustrates that distribution 137 is bi-modal and prone to congestion.

FIG. 5 illustrates an example chart 141 of traffic predictions for the traffic distribution values. The chart 141 may be implemented by a lookup table, index, or spatial data structure. The server 125 may query the chart 141 when receiving the traffic distribution value to retrieve a speed. The speed may be an average speed for the corresponding quintile, a minimum value for the quintile, a maximum value for the quintile, or an average of the minimum value and maximum value for the quintile. Depending on the distribution within a quintile, the average for the quintile may be different than the average of the minimum value and maximum value for the quintile.

The chart 141 may be set up in a variety of techniques. In one example, each time epoch for each path segment for each traffic distribution value includes an entry in the chart 141. In another example, each time epoch for each path across multiple path segments includes an entry in the chart 141. In another example, each time epoch for each type (e.g., functional classification) includes an entry in the chart 141.

In the example of 15 minute epochs, the speed data may be formatted into a 96-dimensional vector for each quintile or other division, in which each of the 96 components describe speed data for a different 15 minute epoch. For example, a quintile vector may have 96 components may be defined as $\vec{x}=(x_1, \ldots, x_n)$, where n=96. A matrix may be formed of the five quintile vectors.

Figure 6:
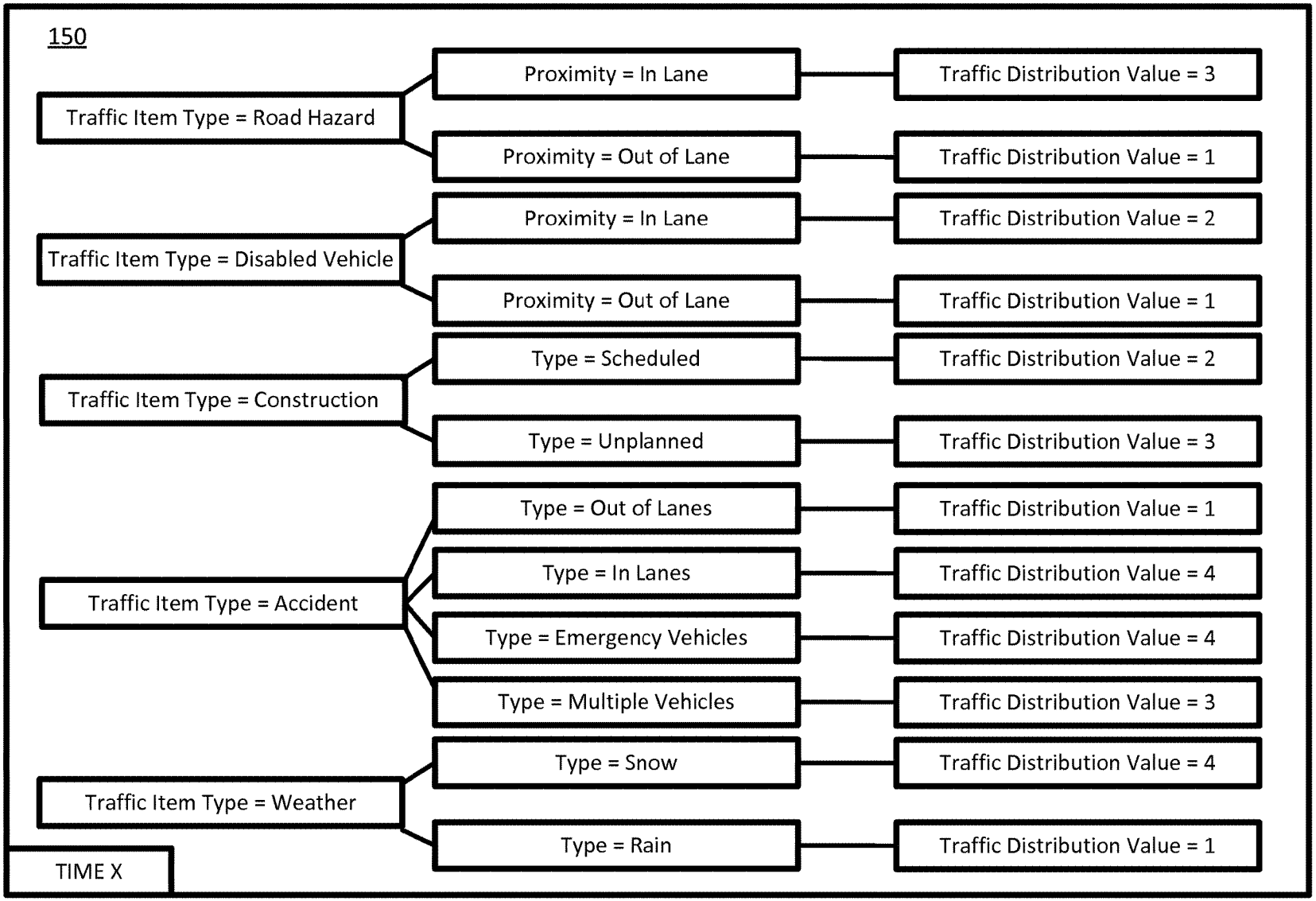
FIG. 6 illustrates an example traffic prediction model for determining the traffic distribution values.

FIG. 6 illustrates an example traffic prediction model 150 for determining the traffic distribution values. The traffic prediction model 150 may be a decision tree. The traffic prediction model 150 may be executed by the server 125 or the mobile device 122. In some examples the traffic prediction model 150 may be defined according to a specific time epoch. The traffic prediction model 150 may receive the indent identifier, which defines a route taken through the stages of the traffic prediction model 150. The first stage of the traffic prediction model 150 may define an incident type. Example types of incident include road hazards, vehicle accidents, weather, and other incidents. A subsequent stage of the traffic prediction model 150 may define an incident attribute.

Multiple layers of incident attributes are possible. One example incident attribute includes location of the incident with respect to the roadway. Example locations include in a lane, on the shoulder, in a median, and other locations. One example incident attribute may be the time since the incident occurred. Another example incident attribute may be the distance between the location of the incident and the location described in the path segment identifier. The traffic prediction model 150 outputs a traffic distribution value, which may be used to access a predicted speed.

Figure 7:
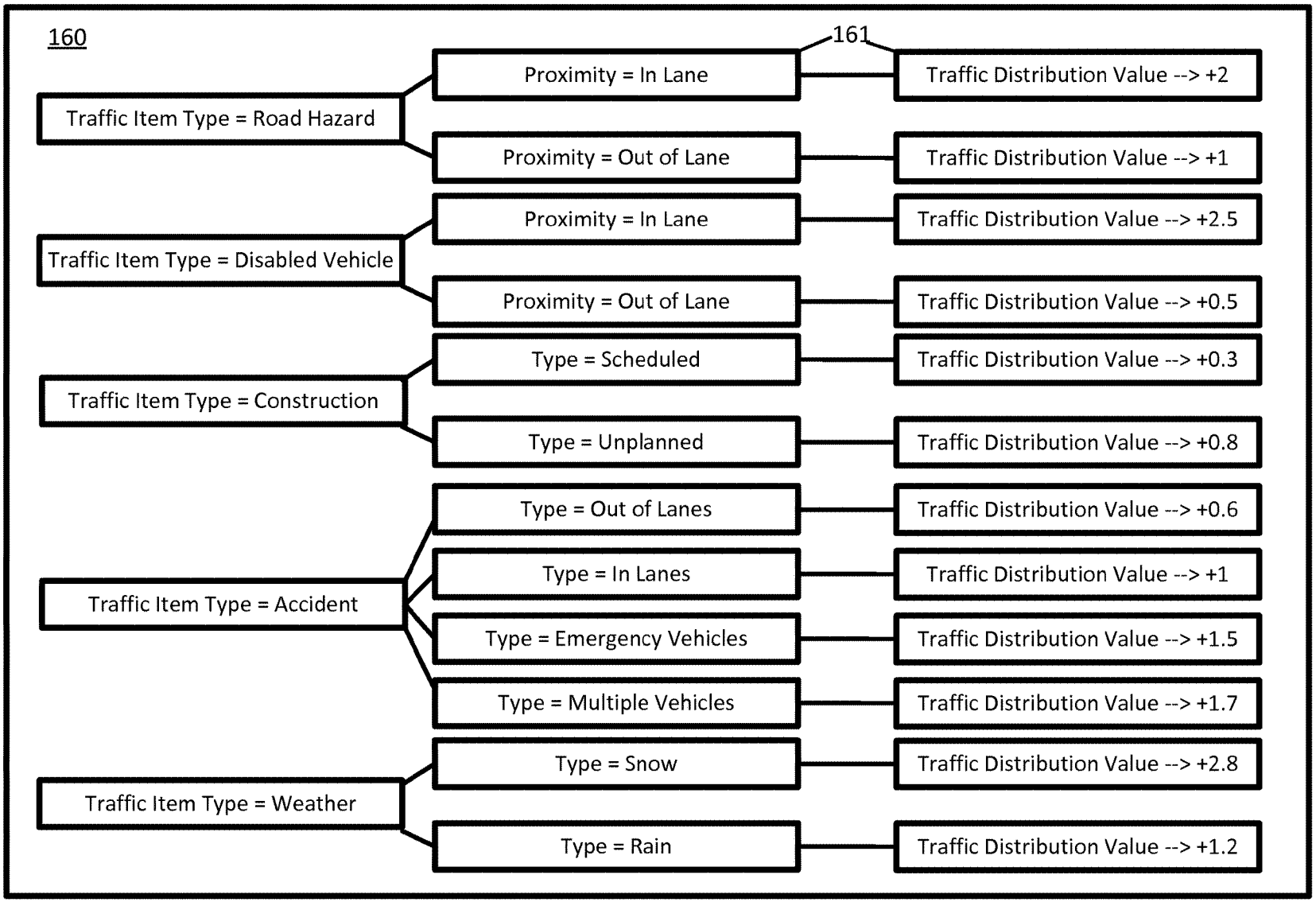
FIG. 7 illustrates another example traffic prediction model for determining the traffic distribution values.

FIG. 7 illustrates a traffic prediction model 160 for determining the traffic distribution values. The traffic prediction model 160 includes multiple decision layers. The first layer branches at various incident types described above. Intermediate layers are not shown for ease of illustration. The final layer of the traffic prediction model 160 may output a traffic distribution value adjustment. The traffic distribution value adjustment may be applied to an expected value in response to the incident.

For example, the server 125 may include a table of expected values for traffic that are indexed by traffic distribution value. The expected values may be organized by path segment and/or time epoch. In order to account for the change in traffic when an incident occurs, the expected value is adjusted. For example, road X and 4:40 P.M. may have an expected traffic distribution value of 1. However, when a road hazard in a traffic lane is reported, as shown by entry 161 in the traffic prediction model 160, the expected traffic distribution is adjusted by +2 to an effective traffic distribution of 3.

Fractional adjustments are also possible. A fractional traffic distribution value may be interpolated. For example, in a proportional interpolation when a traffic distribution value of 2 corresponds to a speed of 10 meters per second and a traffic distribution value of 1 corresponds to a speed of 20 meters per second, a fractional traffic distribution value of 1.2 corresponds to a speed of 18 meters per second. Other interpolation techniques are possible.

The traffic distribution value adjustment may also increase the predicted speed value. In other words, the traffic distribution value adjustment may be negative. Examples of incidents that cause increases in predicted speed, resulting in negative traffic distribution value adjustments, include upstream proximity from a hazard or accident, opening of an additional lanes (e.g., availability of express lanes or a high occupancy vehicle lane), or a traffic volume decrease. The traffic volume may decrease in response to an event (e.g., concert, sporting event, New Year's countdown, or another event) that encourages drivers to stay off of the roads. For example, traffic may be light during the Super Bowl.

Figure 8:
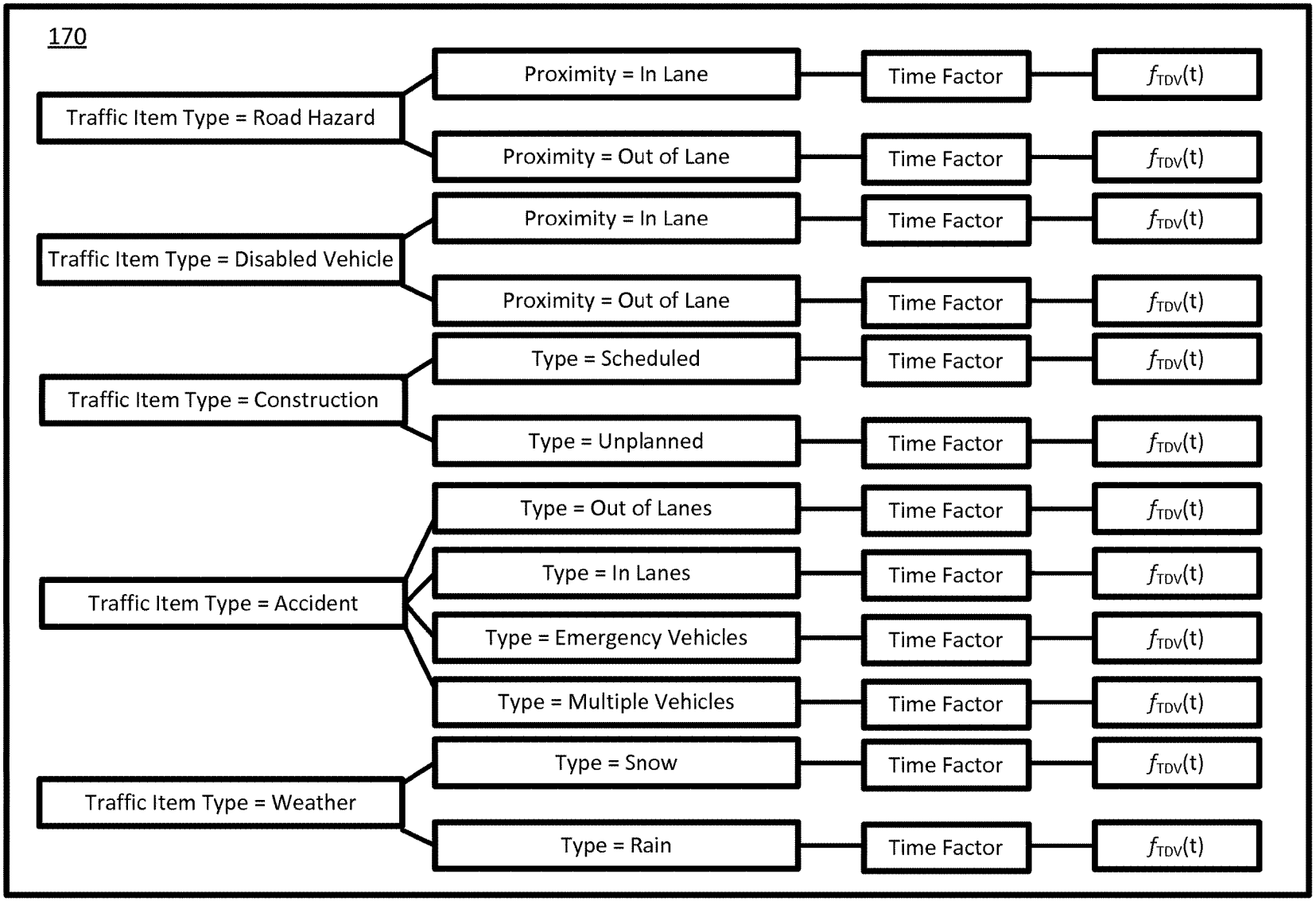
FIG. 8 illustrates another example traffic prediction model for determining the traffic distribution values.

FIG. 8 illustrates another example traffic prediction model 170 for determining the traffic distribution values. The traffic prediction model 170 includes multiple decision layers. The first layer branches at various incident types described above. An intermediate layer may include a time factor. The time factor may decrease the traffic distribution value as time passes. Each entry may have a different time factor. For example, a function $f_{TDV}(t)$ for each entry may adjust the traffic distribution value as a function of time.

Figure 9:
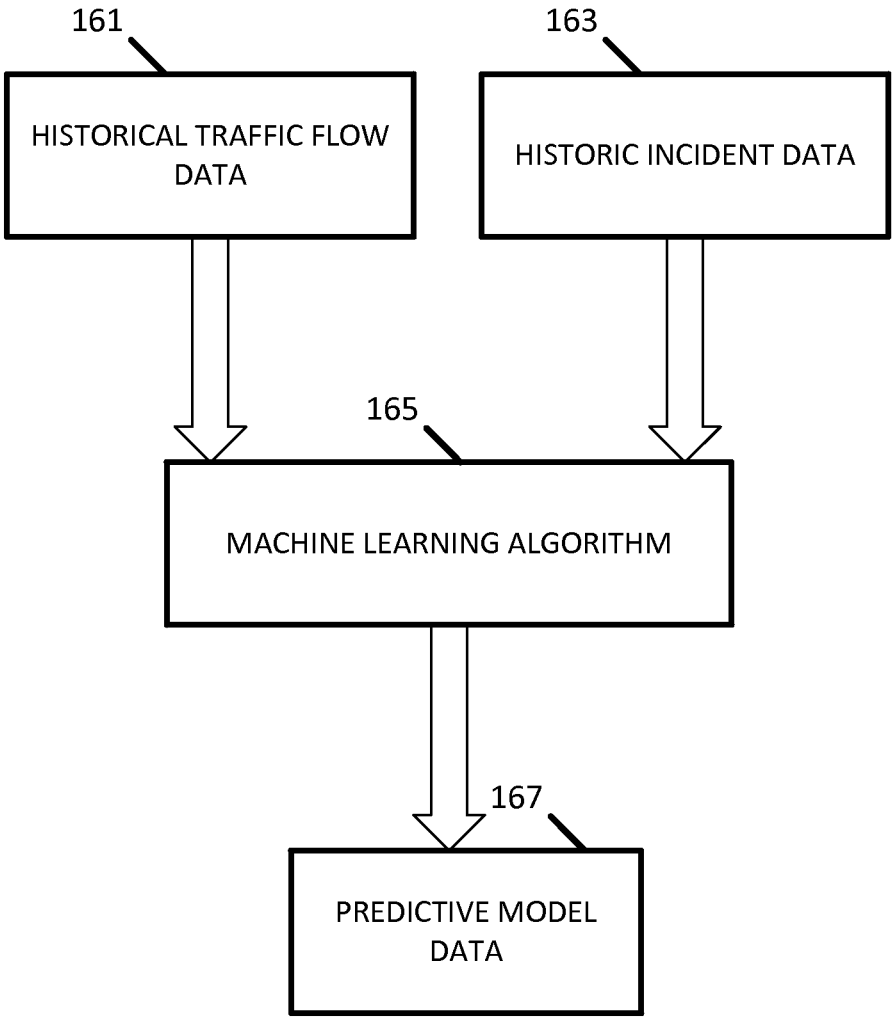
FIG. 9 illustrates an example system for calculating the decision tree of FIG. 4.

FIG. 9 illustrates an example system for calculating the decision tree of FIG. 4. The server 125 or another computing device collects or aggregates historical traffic flow data 161 and historical incident data 163 using a machine learning algorithm 165. The machine learning algorithm 165 may include multiple nodes each having a coefficient calculated based on the historical traffic flow data 161 and the historical incident data 163. Examples for the machine learning algorithm 165 include a neural network, a Bayesian network, decision tree, vector machine, or another algorithm.

Figure 10:
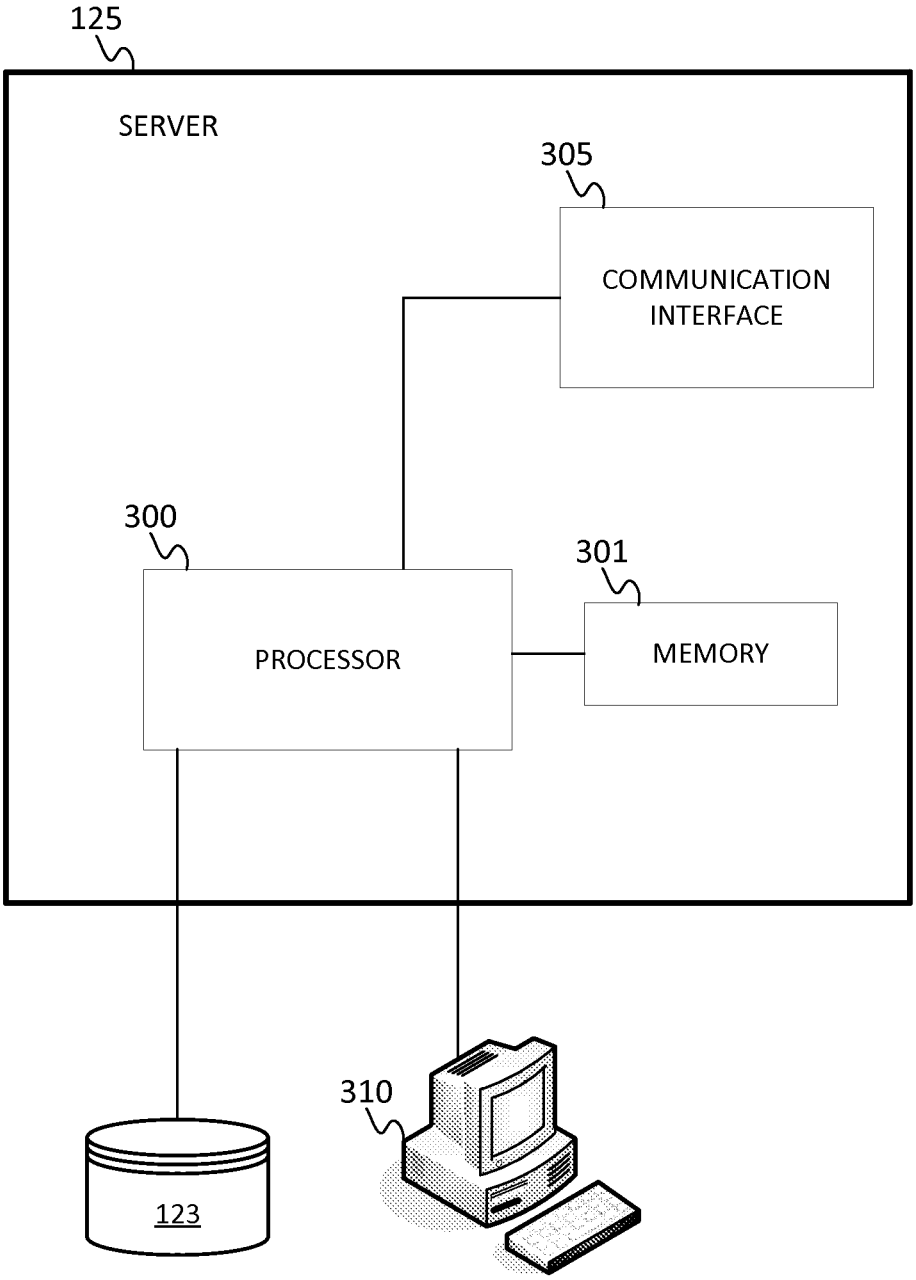
FIG. 10 illustrates an exemplary server of the system of FIG. 1.
Figure 11:
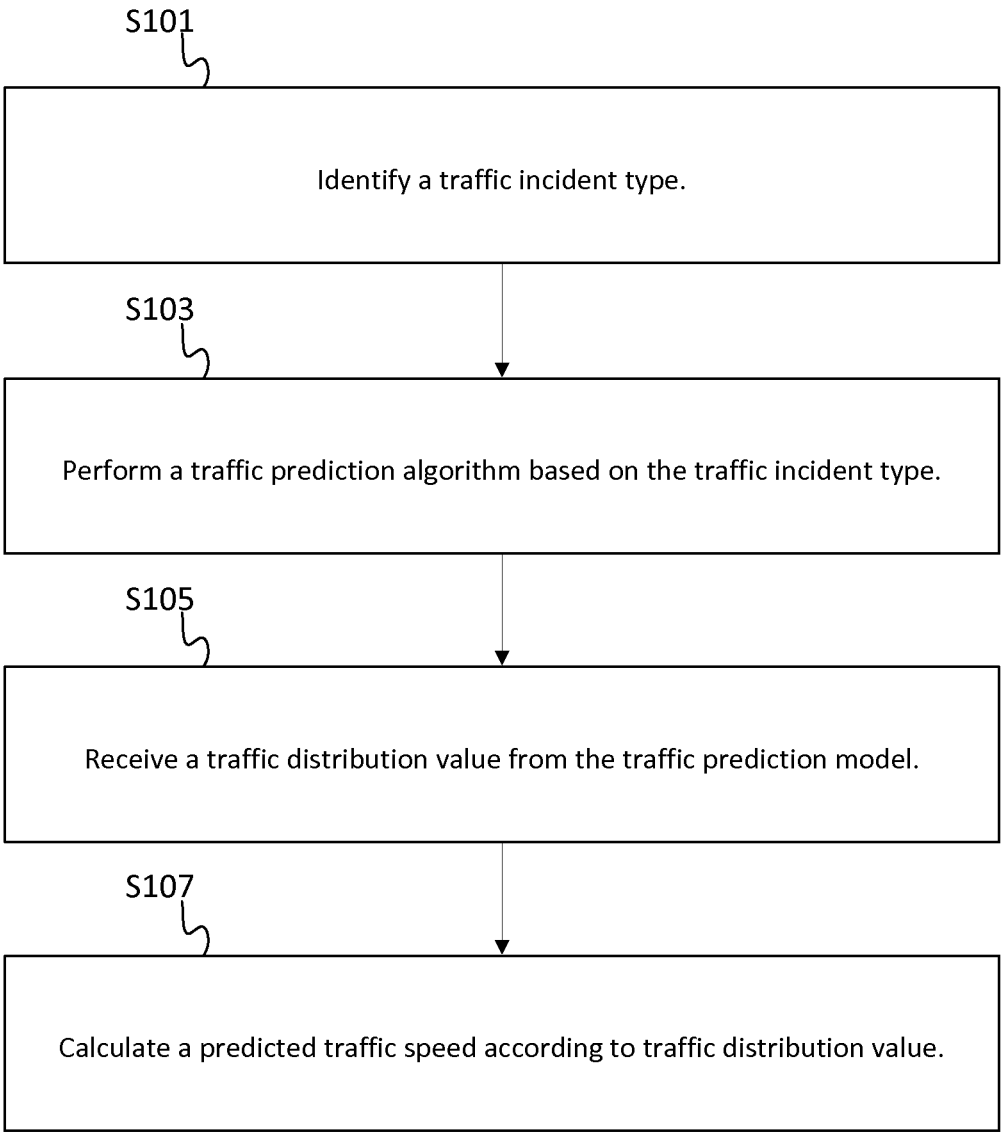
FIG. 11 illustrates example flowchart for aggregate traffic prediction.

FIG. 10 illustrates an exemplary server of the system of FIG. 1. The server 125 includes a processor 300, a communication interface 305, and a memory 301. The server 125 may be coupled to a database 123 and a workstation 310. The workstation 310 may be used as an input device for the server 125. In addition, the communication interface 305 is an input device for the server 125. The communication interface 305 receives data indicative of use inputs made via the workstation 128 or the mobile device 122. Additional, different, or fewer components may be included. FIG. 11 illustrates example flowchart for aggregate traffic prediction, which is described in relation to the server 125 but may be performed by another device. Additional, different, or fewer acts may be provided.

At act S101, the processor 300 identifies a traffic incident type. The processor may extract the traffic incident type from a report received from another device. The traffic incident type may describe an accident, a hazard, a weather event, a flow improving event, or another event. The traffic incident type may describe more specific events such as an accident on the left lane, an accident moved to the shoulder, an accident with injuries, accumulating snow, high winds, a tire in the road, and other examples.

At act S103, the processor 300 may perform a traffic prediction algorithm based on the traffic incident type. The traffic prediction algorithm may associate traffic distribution values with the various incident types. The traffic prediction algorithm may also adjust the traffic distribution values according to a time decay function because the traffic effects of an incident tend to decrease over time. The traffic prediction algorithm may also adjust the traffic distribution values as a function of the distance between the incident and the location for the traffic prediction.

At act S105, the processor 300 receives the traffic distribution value from the traffic prediction algorithm. In some examples, the processor 300 receives the initial traffic distribution value and makes modification as time elapses. At act S107, the processor 300 calculates a predicted traffic speed according to traffic distribution value. The memory 301 may include a lookup table for various paths or path segments. The processor 300 may identify a path to predict traffic for and select the lookup table or portion of the lookup table for that path. The lookup table associates the possible traffic distribution values with historical speeds for the path. The processor 300 receives the speed that corresponds with the traffic distribution value output from the traffic prediction algorithm.

Figure 12:
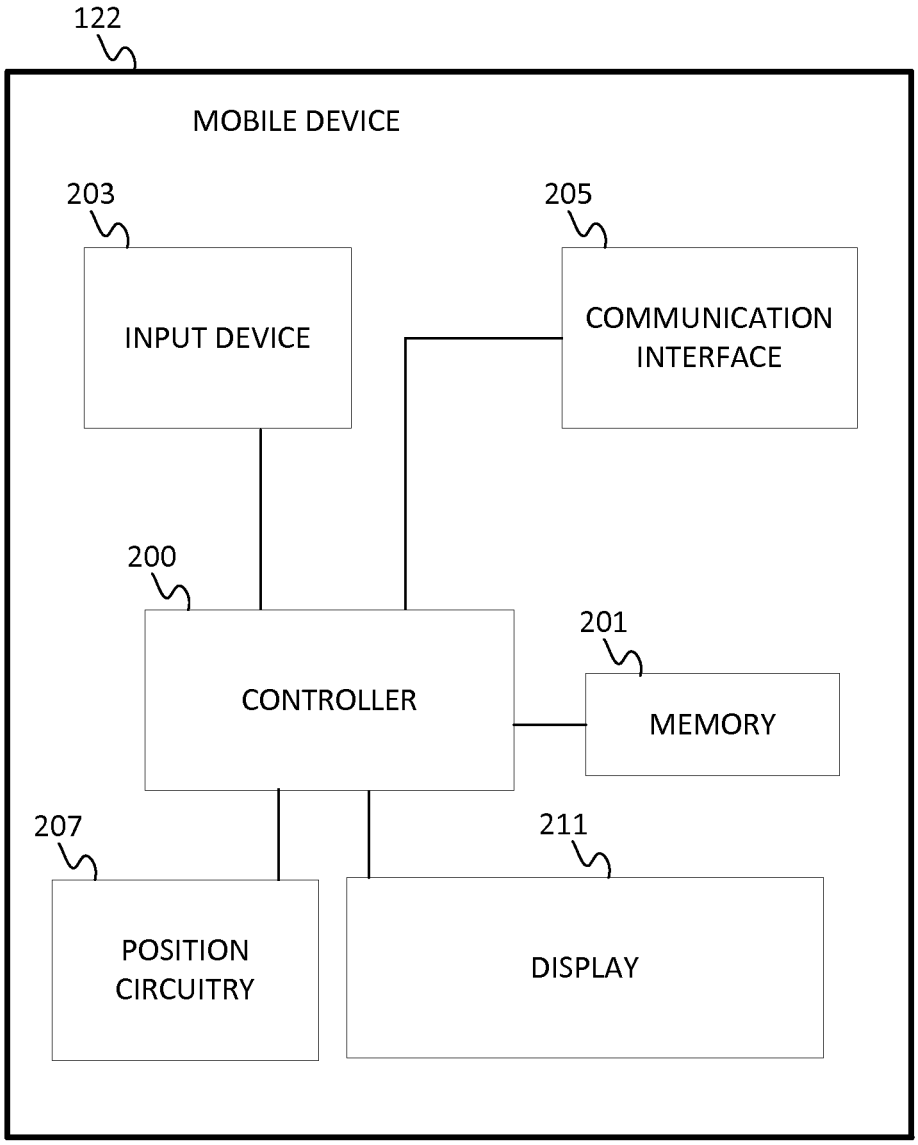
FIG. 12 illustrates an exemplary mobile device of the system of FIG. 1.

FIG. 12 illustrates an exemplary mobile device of the system of FIG. 1. The mobile device 122 may be referred to as a navigation device. The mobile device 122 includes a controller 200, a memory 201, an input device 203, a communication interface 205, position circuitry 207, a camera 209, and a display 211. The workstation 128 may include at least a memory and processor and may be substituted for the mobile device in the following. The mobile device 122 may perform any of the functions described above including executing the traffic prediction models and algorithms and translation traffic distribution values to speed predictions for one or more path segments as a function of time and/or location.

In addition, the mobile device 122 may provide location based services based on the predicted speeds. The controller 200 and communication interface 205 may receive speed predictions directly from the server 125. Alternatively, the communication interface 205 may receive traffic distribution values and the controller 200 calculates the predicted speeds. The location based services may include map services, routing services, speed warnings, incident warnings, or other services.

For map services, the controller 200 may associate the predicted speed values with locations on the maps. The roads may be color coded as a function of speed or speed values may be displayed on the map. The input device 203 may receive a selection of a road from the user and display a speed value in response to the selection.

For speed warnings, the controller 200 may receive the location of the mobile device 122 from the position circuitry 207. When the mobile device 122 is near or traveling toward a road segment in a low speed traffic distribution value (e.g., $4^{th}$ quintile or $3^{rd}$ quintile), the controller 200 may access a speed warning (e.g., congestion ahead) and present the warning on the display 211. The controller 200 may compare the speed predictions for upcoming road segments to a congestion speed threshold. Example congestion speed thresholds include 20 miles per hour or 25 meters per second. When the predicted speed is less that the congestion speed threshold, the display 211 presents the speed warning.

The mobile device 122 may also present incident warnings to the user. When the traffic distribution value is below a threshold (e.g., $2^{nd}$ quintile or any division), the control 201 may generate a message that there is a traffic impacting incident associated with a road segment ahead on in the route of the mobile device 122.

For routing services, the controller 200 or processor 300 may calculate a route based on the traffic distribution values. For example, when calculating a route between an origin and a destination, many routes often exist. The shortest route may be selected. However, when one or more segments of the shortest route are associated with a traffic distribution value below a threshold value because of an incident reported along or near the route, the shortest route may not be selected. In some examples, the controller 200 or the processor 300 may translate the traffic distribution value, or associated speed, with an equivalent additional time or distance that is added to the route.

The database 123 may store or maintain geographic data such as, for example, road segment or link data records and node data records. The link data records are links or segments representing the roads, streets, or paths. The node data records are end points (e.g., intersections) corresponding to the respective links or segments of the road segment data records. The road link data records and the node data records may represent, for example, road networks used by vehicles, cars, and/or other entities. The road link data records may be associated with attributes of or about the roads such as, for example, geographic coordinates, street names, address ranges, speed limits, turn restrictions at intersections, and/or other navigation related attributes (e.g., one or more of the road segments is part of a highway or tollway, the location of stop signs and/or stoplights along the road segments 104), as well as points of interest (POIs), such as gasoline stations, hotels, restaurants, museums, stadiums, offices, automobile dealerships, auto repair shops, buildings, stores, parks, etc. The node data records may be associated with attributes (e.g., about the intersections 106) such as, for example, geographic coordinates, street names, address ranges, speed limits, turn restrictions at intersections, and other navigation related attributes, as well as POIs such as, for example, gasoline stations, hotels, restaurants, museums, stadiums, offices, automobile dealerships, auto repair shops, buildings, stores, parks, etc. The geographic data may additionally or alternatively include other data records such as, for example, POI data records, topographical data records, cartographic data records, routing data, and maneuver data.

The databases 123 may be maintained by one or more map developers (e.g., the first company and/or the second company). A map developer collects geographic data to generate and enhance the database. There are different ways used by the map developer to collect data. These ways include obtaining data from other sources such as municipalities or respective geographic authorities. In addition, the map developer may employ field personnel (e.g., the employees at the first company and/or the second company) to travel by vehicle along roads throughout the geographic region to observe features and/or record information about the features. Also, remote sensing such as, for example, aerial or satellite photography may be used.

The database 123 may be master geographic databases stored in a format that facilitates updating, maintenance, and development. For example, a master geographic database or data in the master geographic database is in an Oracle spatial format or other spatial format, such as for development or production purposes. The Oracle spatial format or development/production database may be compiled into a delivery format such as a geographic data file (GDF) format. The data in the production and/or delivery formats may be compiled or further compiled to form geographic database products or databases that may be used in end user navigation devices or systems.

For example, geographic data is compiled (such as into a physical storage format (PSF) format) to organize and/or configure the data for performing navigation-related functions and/or services, such as route calculation, route guidance, map display, speed calculation, distance and travel time functions, and other functions, by a navigation device. The navigation-related functions may correspond to vehicle navigation, pedestrian navigation, or other types of navigation. The compilation to produce the end user databases may be performed by a party or entity separate from the map developer. For example, a customer of the map developer, such as a navigation device developer or other end user device developer, may perform compilation on a received geographic database in a delivery format to produce one or more compiled navigation databases.

The input device 203 may be one or more buttons, keypad, keyboard, mouse, stylist pen, trackball, rocker switch, touch pad, voice recognition circuit, or other device or component for inputting data to the mobile device 122. The input device 203 and the display 211 may be combined as a touch screen, which may be capacitive or resistive. The display 211 may be a liquid crystal display (LCD) panel, light emitting diode (LED) screen, thin film transistor screen, or another type of display.

The positioning circuitry 207 is optional and may be excluded for the map-related functions. The positioning circuitry 207 may include a Global Positioning System (GPS), Global Navigation Satellite System (GLONASS), or a cellular or similar position sensor for providing location data. The positioning system may utilize GPS-type technology, a dead reckoning-type system, cellular location, or combinations of these or other systems. The positioning circuitry 207 may include suitable sensing devices that measure the traveling distance, speed, direction, and so on, of the mobile device 122. The positioning system may also include a receiver and correlation chip to obtain a GPS signal. Alternatively or additionally, the one or more detectors or sensors may include an accelerometer built or embedded into or within the interior of the mobile device 122. The accelerometer is operable to detect, recognize, or measure the rate of change of translational and/or rotational movement of the mobile device 122. The mobile device 122 receives location data from the positioning system. The location data indicates the location of the mobile device 122.

The controller 200 and/or processor 300 may include a general processor, digital signal processor, an application specific integrated circuit (ASIC), field programmable gate array (FPGA), analog circuit, digital circuit, combinations thereof, or other now known or later developed processor. The controller 200 and/or processor 300 may be a single device or combinations of devices, such as associated with a network, distributed processing, or cloud computing.

The memory 201 and/or memory 301 may be a volatile memory or a non-volatile memory. The memory 201 and/or memory 301 may include one or more of a read only memory (ROM), random access memory (RAM), a flash memory, an electronic erasable program read only memory (EEPROM), or other type of memory. The memory 201 and/or memory 301 may be removable from the mobile device 100, such as a secure digital (SD) memory card.

The communication interface 205 and/or communication interface 305 may include any operable connection. An operable connection may be one in which signals, physical communications, and/or logical communications may be sent and/or received. An operable connection may include a physical interface, an electrical interface, and/or a data interface. The communication interface 205 and/or communication interface 305 provides for wireless and/or wired communications in any now known or later developed format.

The network 127 may include wired networks, wireless networks, or combinations thereof. The wireless network may be a cellular telephone network, an 802.11, 802.16, 802.20, or WiMax network. Further, the network 127 may be a public network, such as the Internet, a private network, such as an intranet, or combinations thereof, and may utilize a variety of networking protocols now available or later developed including, but not limited to TCP/IP based networking protocols.

While the non-transitory computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Although the present specification describes components and functions that may be implemented in particular embodiments with reference to particular standards and protocols, the invention is not limited to such standards and protocols. For example, standards for Internet and other packet switched network transmission (e.g., TCP/IP, UDP/IP, HTML, HTTP, HTTPS) represent examples of the state of the art. Such standards are periodically superseded by faster or more efficient equivalents having essentially the same functions. Accordingly, replacement standards and protocols having the same or similar functions as those disclosed herein are considered equivalents thereof.

A computer program (also known as a program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

As used in this application, the term 'circuitry' or 'circuit' refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Processors suitable for the execution of a computer program include, by way of example, both general and special purpose microprocessors, and anyone or more processors of any kind of digital computer. Generally, a processor receives instructions and data from a read only memory or a random access memory or both. The essential elements of a computer are a processor for performing instructions and one or more memory devices for storing instructions and data. Generally, a computer also includes, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the subject matter described in this specification can be implemented on a device having a display, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, are apparent to those of skill in the art upon reviewing the description.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

We claim:

1. A method comprising:

identifying a traffic incident type and a path segment identifier;

accessing a traffic distribution value based on the traffic incident type and independent of the path segment identifier, wherein the traffic distribution value is a statistical value for assigning a portion of a distribution curve of a predicted traffic model;

determining a speed from the traffic distribution value and the path segment identifier;

modifying the traffic distribution value as a function of an elapsed period of time relative to a timestamp associated with the traffic incident type; and providing for route guidance based, at least in part, on the traffic distribution value.

2. The method of claim 1, further comprising:

accessing a lookup table using the traffic distribution value and the path segment identifier; and receiving the speed from the lookup table, wherein the lookup table comprises at least the path segment identifier and an average quintile speed from the portion of the distribution curve of the predicted traffic model assigned by the traffic distribution value.

3. The method of claim 2, wherein the lookup table includes historical speeds for a path associated with the path segment identifier.

4. The method of claim 1, further comprising:

extracting the traffic incident type from a report received from an external device.

5. The method of claim 4, wherein the external device is a reporting device for an accident, a hazard, a weather event, or a flow improving event.

6. The method of claim 1, wherein the traffic incident type includes an event and a path relative location, wherein the path relative location comprises at least one of a left lane, a right lane, a center lane, a plurality of lanes, a roadway shoulder, a roadway median, or an adjacent roadway.

7. The method of claim 1, further comprising:

adjusting the traffic distribution value according to a time decay function modeled for the identified traffic incident type.

8. The method of claim 1, further comprising:

providing map data including the speed determined from the traffic distribution value and the path segment identifier.

9. The method of claim 1, further comprising:

modifying the traffic distribution value as a function of distance between a location of the incident and a location identified by the path segment identifier.

10. An apparatus comprising:

at least one processor; and at least one memory including computer program code for one or more programs; the at least one memory and the computer program code configured to, with the at least one processor, cause the apparatus to perform at least the following:

identify a traffic incident type and a path segment identifier;

access a traffic distribution value based on the traffic incident type and independent of the path segment identifier, wherein the traffic distribution value is a statistical value for assigning a portion of a distribution curve of a predicted traffic model;

determine a speed from the traffic distribution value and the path segment identifier;

modify the traffic distribution value as a function of an elapsed period of time relative to a timestamp associated with the traffic incident type; and provide for route guidance based, at least in part, on the traffic distribution value.

11. The apparatus of claim 10, the at least one memory and the computer program code configured to, with the at least one processor, cause the apparatus to perform:

access a lookup table using the traffic distribution value and the path segment identifier; and receive the speed from the lookup table, wherein the lookup table comprises at least the path segment identifier and an average quintile speed from the portion of the distribution curve of the predicted traffic model assigned by the traffic distribution value.

12. The apparatus of claim 11, wherein the lookup table includes historical speeds for a segment associated with the path segment identifier.

13. The apparatus of claim 10, the at least one memory and the computer program code configured to, with the at least one processor, cause the apparatus to perform: extract the traffic incident type from a report received from an external device.

14. The apparatus of claim 13, wherein the external device is a reporting device for an accident, a hazard, a weather event, or a flow improving event.

15. The apparatus of claim 10, wherein the traffic incident type includes an event and a path relative location, wherein the path relative location comprises at least one of a left lane, a right lane, a center lane, a plurality of lanes, a roadway shoulder, a roadway median, or an adjacent roadway.

16. The apparatus of claim 10, the at least one memory and the computer program code configured to, with the at least one processor, cause the apparatus to perform:

adjust the traffic distribution value according to a time decay function modeled for the identified traffic incident type.

17. A non-transitory computer-readable medium including instructions that when executed by a processor cause a computer system to perform:

identifying a traffic incident type and a path segment identifier;

accessing a traffic distribution value based on the traffic incident type and independent of the path segment identifier, wherein the traffic distribution value is a statistical value for assigning a portion of a distribution curve of a predicted traffic model;

determining a speed from the traffic distribution value and the path segment identifier;

modifying the traffic distribution value as a function of an elapsed period of time relative to a timestamp associated with the traffic incident type; and providing for route guidance based, at least in part, on the traffic distribution value.

18. The computer readable medium of claim 17, the instructions further comprising:

accessing a lookup table using the traffic distribution value and the path segment identifier; and receiving the speed from the lookup table, wherein the lookup table comprises at least the path segment identifier and an average quintile speed from the portion of the distribution curve of the predicted traffic model assigned by the traffic distribution value.

19. The computer readable medium of claim 17, the instructions further comprising:

adjusting the traffic distribution value according to a time decay function modeled for the identified traffic incident type.

* * * * *